US009069368B2

(12) United States Patent
Patel

(10) Patent No.: US 9,069,368 B2
(45) Date of Patent: Jun. 30, 2015

(54) LIGHT LOAD STABILITY CIRCUITRY FOR LDO REGULATOR

(71) Applicant: Linear Technology Corporation, Milpitas, CA (US)

(72) Inventor: Amitkumar Pravin Patel, Milpitas, CA (US)

(73) Assignee: Linear Technology Corporation, Milpitas, CA (US)

( * ) Notice: Subject to any disclaimer, the term of this patent is extended or adjusted under 35 U.S.C. 154(b) by 230 days.

(21) Appl. No.: 13/946,816

(22) Filed: Jul. 19, 2013

(65) Prior Publication Data

US 2014/0312864 A1 Oct. 23, 2014

Related U.S. Application Data

(60) Provisional application No. 61/813,472, filed on Apr. 18, 2013.

(51) Int. Cl.
*G05F 1/575* (2006.01)
*G05F 1/46* (2006.01)

(52) U.S. Cl.
CPC ..... *G05F 1/461* (2013.01); *G05F 1/575* (2013.01)

(58) Field of Classification Search
CPC ..... G05F 1/461; G05F 1/462; G05F 1/463; G05F 1/465; G05F 1/466; G05F 1/468; G05F 1/56; G05F 1/561; G05F 1/562; G05F 1/565; G05F 1/575
See application file for complete search history.

(56) References Cited

U.S. PATENT DOCUMENTS

| | | | | |
|---|---|---|---|---|
| 5,852,359 | A * | 12/1998 | Callahan et al. | 323/274 |
| 7,573,246 | B2 * | 8/2009 | Lin et al. | 323/273 |
| 2004/0051508 | A1 * | 3/2004 | Hamon et al. | 323/280 |
| 2006/0164053 | A1 * | 7/2006 | Walter et al. | 323/282 |
| 2008/0157735 | A1 * | 7/2008 | Liu et al. | 323/280 |

* cited by examiner

*Primary Examiner* — Harry Behm
(74) *Attorney, Agent, or Firm* — Patent Law Group LLP; Brian D. Ogonowsky

(57) ABSTRACT

A linear regulator contains an additional AC-coupled feedback loop between the output of the error amplifier and the base of the pass transistor that increases the frequency of the pole at the output of the error amplifier at light load currents to at least partially offset the decreased frequency of the output pole at the lighter load currents. Thus, a desired phase margin is preserved. The AC-coupled feedback loop includes a bipolar feedback transistor connected in parallel with the pass transistor. A resistor is connected to the emitter of the feedback transistor to reduce the relative gain of the feedback transistor above light load currents. A feedback capacitor Cfb is connected between the collector of the feedback transistor and the output of the error amplifier. The negative AC feedback increases the pole frequency at the output of the error amplifier and the base of the pass transistor.

20 Claims, 2 Drawing Sheets

LIGHT LOAD STABILITY CIRCUITRY FOR LDO REGULATOR

CROSS-REFERENCE TO RELATED APPLICATIONS

This application claims priority to U.S. Provisional Application Ser. No. 61/813,472, filed Apr. 18, 2013, by Amitkumar Patel, assigned to the present assignee and incorporated herein by reference.

FIELD OF THE INVENTION

This invention relates to linear regulator integrated circuits and, in particular, to a feedback circuit coupled to an error amplifier in such an IC that improves the stability of the regulator at light load currents.

BACKGROUND

FIG. 1 illustrates one representative prior art linear regulator 10, which is a negative voltage regulator, although the invention applies equally to positive linear regulators. The term "linear regulator" is generally synonymous with a "low dropout (LDO) regulator." The term "low dropout" refers to the small minimum voltage differential that can occur between the input voltage terminal and the regulated output voltage terminal while still achieving regulation.

LDO regulators operate by varying the conductivity of a pass (or series) transistor, connected between the input terminal and the output terminal, to achieve a predetermined output voltage. The output level of a transconductance amplifier, which is a type of differential amplifier, controls the conductivity of the pass transistor. The amplifier is referred to herein as an error amplifier. Typically, the regulator's output voltage is fed back into one input terminal of the error amplifier, and the conductivity of the pass transistor is controlled to match the output voltage to a reference voltage applied to the other input of the error amplifier. The user selects the reference voltage. Alternatively, a divided output voltage is fed back and matched to a fixed reference voltage, where the user selects resistors for the divider to achieve the desired output voltage. The invention applies equally to either type of feedback.

In FIG. 1, a fixed reference voltage Vref may be generated by the user connecting resistor (not shown) between a Set pin (not shown) of the regulator IC and ground to set the output voltage Vout provided at the Vout terminal 12. An on-chip current source (not shown) draws a fixed current through the resistor, and the voltage drop across the resistor is Vref.

A load (Rload) is typically connected between the Vout terminal 12 and ground. The input voltage Vin (a negative voltage in this example, usually Vee) is applied to the Vin terminal 14, so Vout will be somewhere between Vin (minus the dropout voltage) and ground. The reference voltage Vref is applied to the inverting input of the error amplifier 16. The output voltage Vout is applied to the non-inverting input of the error amplifier 16. The terms inverting and non-inverting simply refer to the two branches of the differential amplifier in the error amplifier 16.

The "error" output of the error amplifier 16 charges and discharges a capacitor Cea, connected to the output of the error amplifier 16 via a resistor Rea, to create a control voltage Vc. The control voltage Vc is that required to keep Vout equal to Vref at the inputs of the error amplifier 16. The values of Rea and Cea are optimized to ensure stability within the specified bandwidth of the regulator 10.

A driver 18 (a buffer) generates the required current to control the bipolar transistor Q1, which may be a high power transistor.

A relatively large output capacitor Cout is connected to the Vout terminal 12 to hold the output voltage steady during fast load transients, and the value of Cout is optimized to ensure stability under varying operating conditions, such as temperature, load current, etc.

Since the transistor Q1 may be large, its parasitic base capacitance Cb may be significant.

The circuit of FIG. 1 has three poles (Pole 1, Pole 2, and Pole 3), where a capacitance causes the voltage to lag the current by 90 degrees. Since the regulator 10 uses negative feedback (180 degrees out of phase), the feedback signal cannot be an additional 180 out of phase at the input of the error amplifier 16 while the feedback loop has a gain of unity, or else the negative feedback will turn into positive feedback and there will be instability. A good design rule is to have at least 45 degrees phase margin when the overall gain of the feedback loop crosses unity at the unity gain frequency (also referred to as the bandwidth frequency). The parasitic pole frequencies should occur well outside of the unity gain frequency.

FIG. 2 illustrates a simple one-pole circuit consisting of a resistor and a capacitor in series. Vin is applied between the ends of the resistor and the capacitor, and Vout is the voltage across the capacitor. The pole frequency is the frequency at which the impedance of the capacitor equals the value of the resistor, such that Vout equals Vin/2 (the −3 dB point). This is represented by the equation $f=1/(2\pi RC)$.

One problem with the conventional regulator 10 is that the size of the output capacitor Cout is designed for worst case conditions that occur at the highest load current. At this high load current, transistor Q1 is generally highly conducting, causing the Pole 3 frequency to be relatively high, giving the feedback loop a good phase margin. Typically, the value of the capacitor Cout is selected to provide the desired phase margin (e.g., greater than 45 degrees) at the bandwidth frequency at the maximum specified load current. However, at lighter load currents, when transistor Q1 is lightly conducting, the Pole 3 frequency drops significantly, reducing the phase margin of the feedback loop, such as to below 45 degrees.

Given that the capacitors in the regulator 10 are optimized for the high load current, it would be beneficial to somehow offset the decreased Pole 3 frequency at the lighter load current to maintain approximately the same phase margin at both high and low load currents.

SUMMARY

In one embodiment, a linear regulator IC adds an additional AC-coupled feedback loop between the output of the error amplifier and the base of the pass transistor that increases the frequency of the Pole 1 and Pole 2 at lighter load currents to at least partially offset the decreased frequency of the output Pole 3 at the lighter load currents.

The AC-coupled feedback loop includes a bipolar feedback transistor connected in parallel with the much larger-power pass transistor. For a negative voltage regulator, the base of the feedback transistor is coupled to the output of the driver, its emitter is coupled to Vee (Vin) via an emitter resistor, and its collector is coupled to ground via a high value collector resistor to keep the collector impedance high.

A feedback capacitor Cfb is connected between the collector of the feedback transistor and the output of the error amplifier.

Since the driver is connected to the base of both the NPN pass transistor and the NPN feedback transistor, as the base current output of the driver is increased to supply an increased load current, the feedback transistor's gain decreases due to the increased voltage drop across its emitter resistor (lowering Vbe to below 0.7 volts). Meanwhile the gain of the pass transistor is high. Therefore, the added feedback loop does not significantly affect the performance (e.g., phase margin) of the regulator when the load current is above a light load current threshold. Further, since the added feedback loop is AC coupled, it does not affect the DC performance of the regulator.

When the base current is sufficiently low (occurring at light load currents), the feedback transistor, having a relatively high gain, draws an amplified current through its collector resistor and emitter resistor. This pulls down one end of the feedback capacitor Cfb. When there is an AC signal (e.g., transients) at the output of the error amplifier, some of the AC current flows into the capacitor Cfb, creating a lower impedance at the output of the error amplifier to AC signals. This increases the pole (i.e., the −3 dB frequency) at the output of the error amplifier at low load currents. Increasing the value of Cfb lowers the impedance. This also increases the pole at the input of the pass transistor.

Accordingly, as the regulator's output pole decreases in frequency with decreasing load currents, the error amplifier's output pole increases in frequency, and the pass transistor's base pole increases in frequency, to at least partially offset the decrease in the regulator's output pole frequency at the lighter load currents. Therefore, the phase margin (a combination of the effects of all the poles and zeros) is not reduced at the lighter loads.

The invention also applies to a positive LDO regulator, where the positive input voltage is applied to the emitter of a PNP pass transistor, and the load is connected between the collector of the pass transistor and ground. The invention applies to various other embodiments of linear regulators using an error amplifier.

Various other embodiments are described.

BRIEF DESCRIPTION OF THE DRAWINGS

Elements that are the same or equivalent are labeled with the same numeral.

DETAILED DESCRIPTION

Figure 1:
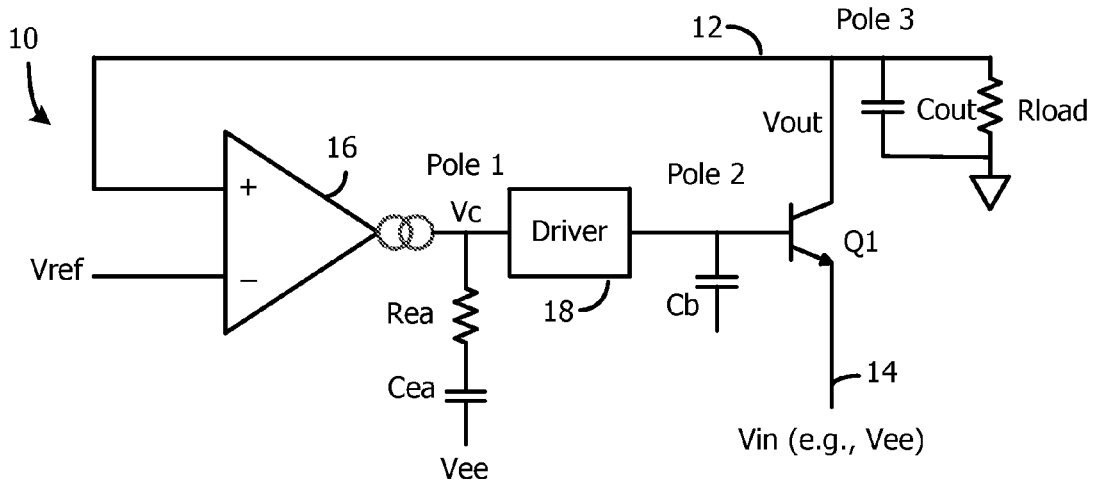
Fig. 1 (prior art)
FIG. 1 illustrates a conventional negative voltage linear regulator.
Figure 2:
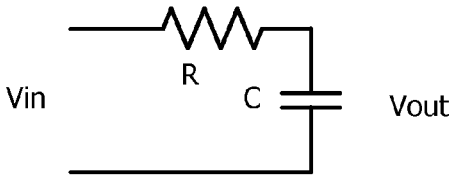
Fig. 2 (prior art)
FIG. 2 illustrates a simple one-pole circuit.
Figure 3:
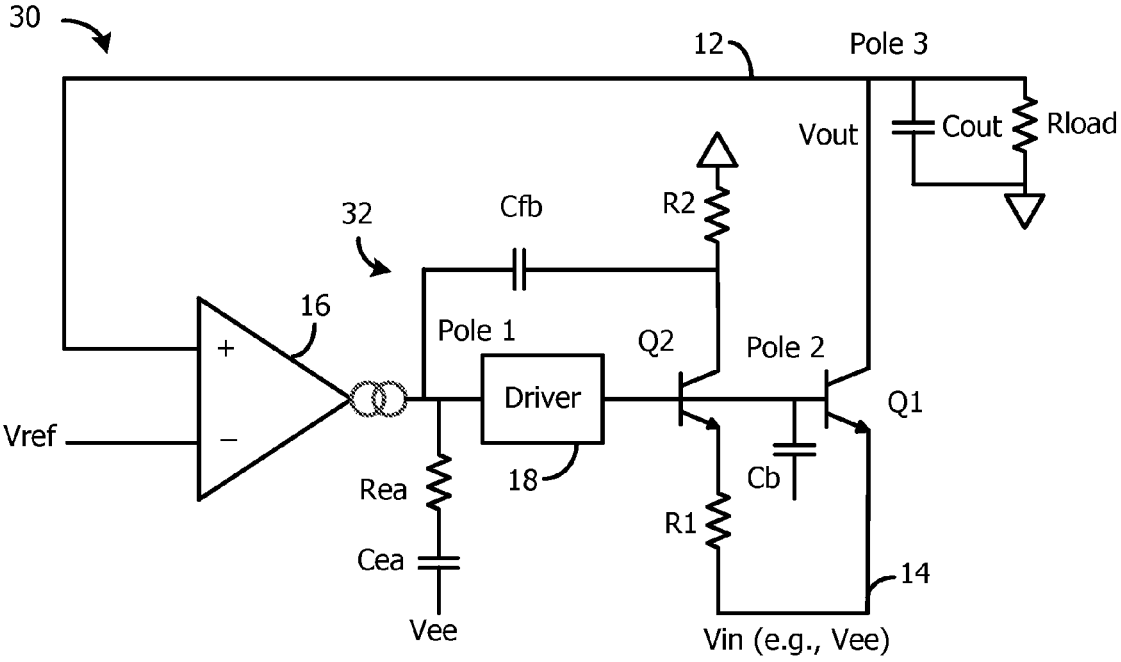
FIG. 3 illustrates the regulator of FIG. 1 augmented with an AC feedback loop, in accordance with one embodiment of the invention.

The negative voltage linear regulator 30 of FIG. 3 illustrates an AC feedback loop 32 added to the regulator of FIG. 1 to increase the phase margin at light load currents by offsetting a reduction in the regulator's output pole frequency at the light load currents. The common elements in FIGS. 1 and 3 are labeled the same, and their operations were described above. Additional circuitry may be added between the various components.

All elements may be formed on a single integrated circuit except the capacitors Cea and Cout.

A low power NPN bipolar transistor Q2 has its base connected to the output of the driver 18. The driver 18 also drives the base of the higher-power NPN pass transistor Q1 so that Vout substantially matches Vref.

Vref may be generated by the user connecting an external resistor (not shown) between a Set pin (not shown) of the IC and ground. An on-chip current source (not shown) draws a specified fixed current through the resistor to generate Vref. In another embodiment, a divided output voltage is fed back to the error amplifier 16 and matched to a fixed reference voltage (typically about 1.2 volts), where the user selects resistors for the divider to achieve the desired output voltage. The invention applies equally to either type of feedback.

The emitter of transistor Q2 is connected to Vin (typically Vee) via an emitter resistor R1. The collector of transistor Q2 is connected to ground via a high value collector resistor R2 to provide a high collector impedance.

The base voltage of transistor Q2 is set by the Vbe of transistor Q1 (about 0.7 volts). The base current increases with the required load current. At a high enough emitter current through resistor R1, the Vbe of transistor Q2 will be significantly reduced compared to the Vbe of transistor Q1, and the gain of transistor Q2 will be significantly lower than the gain of the pass transistor Q1. This makes the AC-coupled feedback loop 32 basically ineffectual at the higher load currents. A feedback capacitor Cfb is connected between the output of the error amplifier 16 and the collector of transistor Q2. At the lighter load currents, when the gain of transistor Q2 is relatively high, the AC feedback loop (acting as a negative feedback loop for AC signals) becomes very effective in lowering the impedance at the error amplifier 16 output. A larger value of Cfb lowers the impedance. Since the AC signal applied to the base of the pass transistor Q1 is reduced at the lighter load currents due to the loop, both the Poles 1 and 2 are pushed up to higher frequencies. Since, as discussed with respect to FIG. 1, the Pole 3 frequency is reduced at light load currents, the increase in the Pole 1 and Pole 2 frequencies at light load currents at least partially offsets the decrease in phase margin due to Pole 3 at the light load currents.

In one embodiment, the gain of the AC-coupled feedback loop is greater than one below the light load current threshold and less than one above the light load current threshold.

Since the feedback circuit 32 is AC-coupled, it has no effect on the DC performance of the regulator 30. Therefore, the DC loop gain and accuracy of the regulator 30 are not affected.

The optimal values of the capacitor Cfb, resistor R1, and resistor R2 may be determined by simulation for the particular application.

Figure 4:
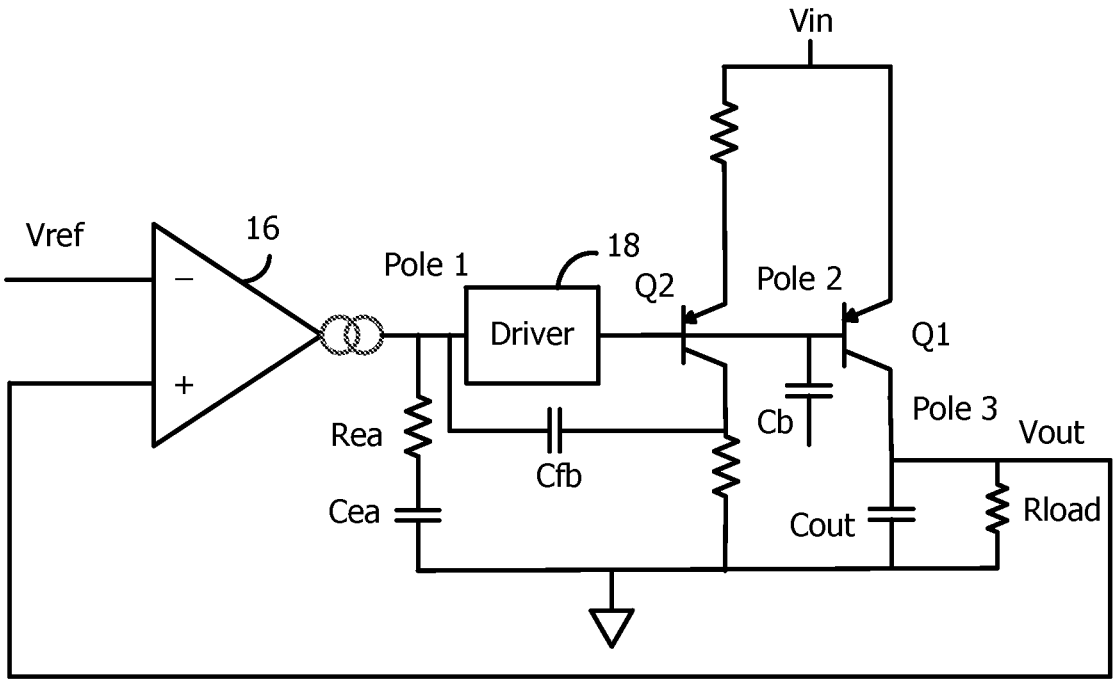
FIG. 4 illustrates a positive voltage regulator in accordance with another embodiment of the invention.

The AC-feedback loop can be similarly applied to a positive linear regulator, as shown in FIG. 4. In such a regulator, the positive input voltage is applied to the emitter of the PNP pass transistor Q1, and the load (and output capacitor) is connected between the collector of transistor Q1 and ground. The remaining terminals are referenced to ground rather than Vee.

While particular embodiments of the present invention have been shown and described, it will be obvious to those skilled in the art that changes and modifications may be made without departing from this invention in its broader aspects and, therefore, the appended claims are to encompass within their scope all such changes and modifications that are within the true spirit and scope of this invention.

What is claimed is:

1. A linear regulator circuit for generating a regulated output voltage comprising:

an error amplifier having differential inputs, including a first input and a second input;

the first input being connected to a reference voltage, and the second input corresponding to an output voltage of the regulator, the regulator being controlled to cause the voltage at the second input to substantially equal the voltage at the first input;

a bipolar pass transistor connected between an input voltage and a load;

a driver circuit coupled between an output of the error amplifier and a base of the pass transistor; and an AC-coupled feedback circuit comprising:

a bipolar feedback transistor having a base coupled to the base of the pass transistor;

an emitter resistor coupled to the emitter of the feedback transistor;

a collector resistor coupled to the collector of the feedback transistor; and a feedback capacitor coupled between a collector of the feedback transistor and the output of the error amplifier, the feedback circuit being configured to increase a phase margin of the regulator at load currents below a certain threshold, wherein the feedback circuit is substantially ineffectual at load currents substantially above the threshold.

2. The circuit of claim 1 wherein a first pole exists at an output of the error amplifier, and wherein a frequency of the first pole is increased by the feedback circuit at load currents below the certain threshold.

3. The circuit of claim 2 wherein a second pole exists at a base of the pass transistor, and wherein a frequency of the second pole is increased by the feedback circuit at load currents below the certain threshold.

4. The circuit of claim 1 wherein the regulator is a negative voltage regulator.

5. The circuit of claim 4 wherein the feedback transistor is an NPN transistor, and wherein the collector of the NPN transistor is coupled to ground via a collector resistor.

6. The circuit of claim 1 wherein the regulator is a positive voltage regulator.

7. The circuit of claim 6 wherein the feedback transistor is a PNP transistor, and wherein the collector of the PNP transistor is coupled to ground via a collector resistor.

8. The circuit of claim 1 wherein the input voltage is coupled to the emitter of the feedback transistor via the emitter resistor.

9. The circuit of claim 1 wherein a gain of the feedback transistor relative to a gain of the pass transistor increases at load currents below the certain threshold, and the gain of the feedback transistor relative to the gain of the pass transistor decreases at load currents substantially above the certain threshold.

10. The circuit of claim 1 further comprising an error amplifier capacitor coupled to an output of the error amplifier.

11. The circuit of claim 10 wherein the error amplifier capacitor is coupled to the output of the error amplifier via an error amplifier resistor.

12. The circuit of claim 1 wherein the error amplifier is a transconductance amplifier.

13. The circuit of claim 1 wherein the feedback circuit is configured to lower an impedance at the output of the error amplifier for AC signals when the load current is below the certain threshold.

14. A method performed by a linear regulator circuit for generating a regulated output voltage comprising:

applying a reference voltage to a first input of an error amplifier:

applying a signal, corresponding to an output voltage of the regulator, to a second input of the error amplifier;

driving a base of a bipolar pass transistor, the pass transistor being connected between an input voltage and a load, by a driver controlled by an output of the error amplifier to cause the voltage at the second input to substantially equal the reference voltage at the first input;

providing negative feedback of an AC signal generated by the error amplifier by an AC-coupled feedback circuit, the feedback circuit comprising:

a bipolar feedback transistor having a base coupled to the base of the pass transistor;

an emitter resistor coupled to the emitter of the feedback transistor; and a feedback capacitor coupled between a collector of the feedback transistor and the output of the error amplifier, the feedback circuit performing the method comprising:

lowering an output impedance at the output of the error amplifier for AC signals at load currents below a certain threshold to increase a phase margin of the regulator, wherein the feedback circuit is substantially ineffectual at load currents substantially above the threshold.

15. The method of claim 14 wherein a first pole exists at an output of the error amplifier, and wherein a frequency of the first pole is increased by the feedback circuit at load currents below the certain threshold.

16. The method of claim 15 wherein a second pole exists at a base of the pass transistor, and wherein a frequency of the second pole is increased by the feedback circuit at load currents below the certain threshold.

17. The method of claim 14 wherein the feedback transistor is an NPN transistor, and wherein the collector of the NPN transistor is coupled to ground via a collector resistor.

18. The method of claim 14 wherein the feedback transistor is a PNP transistor, and wherein the collector of the PNP transistor is coupled to ground via a collector resistor.

19. The method of claim 14 wherein the input voltage is coupled to the emitter of the feedback transistor via the emitter resistor.

20. The method of claim 14 wherein a gain of the feedback transistor relative to a gain of the pass transistor increases at load currents below the certain threshold, and the gain of the feedback transistor relative to the gain of the pass transistor decreases at load currents substantially above the certain threshold.

* * * * *